US005087089A

United States Patent [19]

Lee

[11] Patent Number: 5,087,089

[45] Date of Patent: Feb. 11, 1992

[54] BAG SECURITY SEAL AND METHOD OF MANUFACTURING SAME

[76] Inventor: Leon L. M. Lee, 15/F., Caltex House, 258 Hennessey Rd., Wanchai, Hong Kong

[21] Appl. No.: 722,154

[22] Filed: Jun. 27, 1991

[51] Int. Cl.[5] ..... B65D 33/34

[52] U.S. Cl. ..... 292/308

[58] Field of Search ..... 292/315, 310, 312, 317, 292/307 R, 326, 309, 308; 29/526

[56] References Cited

U.S. PATENT DOCUMENTS

| | | | |
|---|---|---|---|
| 331,439 | 12/1885 | Pond | 292/308 |
| 990,629 | 4/1911 | Brooks | 292/310 |
| 2,314,814 | 3/1943 | Borland | 292/315 |
| 2,496,905 | 2/1950 | Brooks | 292/310 |
| 2,899,230 | 8/1959 | Moberg | 292/325 |

*Primary Examiner*—Richard E. Moore

*Attorney, Agent, or Firm*—Antonelli, Terry, Stout & Kraus

[57] ABSTRACT

A tamperproof security seal for a container and a method of manufacturing the same wherein a seal member is provided with a plurality of partition walls disposed in parallel to one another and in parallel to the end wall sections so as to define a plurality of channels extending across a width of the seal mamber. A plurality of holes are provided in each of the partition walls and in the end walls sections, with the holes extending through the partition walls and the end walls sections in a direction perpendicular to a longitudinal center axis of the respective channels. The holes in the partition walls and the end walls sections are disposed in alignment so as to enable a drawstring to be threaded therethrough. Upon a crimping of the seal member, the partition walls and the end walls sections are deformed so that the openings form individual anchoring or fixing points on the drawstring so as to prevent a withdraw of the drawstring from the seal member and prevent unauthorized access to the container.

7 Claims, 2 Drawing Sheets

BAG SECURITY SEAL AND METHOD OF MANUFACTURING SAME

FIELD OF THE INVENTION

The present invention relates to a seal, and, more particularly, to a security seal for sealing bags or pouches such as, for example, currency bags, mail bags or the like.

BACKGROUND OF THE INVENTION

Various types of security seals for sealing bags or the like have been proposed and, for example, the most common security seal consists essentially of a lead seal member having a plurality of through holes therein through which a drawstring or the like is serially passed, with the lead seal member being subsequently crimped by a crimping tool so as to secure the drawstrings around an opening of the bag and thereby prevent access thereto.

One disadvantage of the conventional lead type security seal resides in the fact that, if the seal is not properly crimped, it is possible to loosen the drawstring sufficiently to gain access to the bag without removing the drawstring, tamper with the contents of the bag, and redraw and drawstring without providing any evidence of tampering.

Another disadvantage of the lead seal resides in the fact that the seal is not reusable and, to gain authorized entry, the lead seal member is generally severed and discarded.

U.S. Pat. No. 4,342,477 proposes a security seal with a break-off screw head securement wherein a block shaped retainer is provided with through holes so as to permit the passage of a drawstring, with a manual anchoring of the tie member in the retainer being accomplished by engagement of a working end of a screw head against the drawstring, with the head of the screw then being broken off and discarded.

Recently, more attempts have been given to environmental issues and there is considerable concern relating to the use of lead and the subsequent disposal thereof. Thus, attempts have been made to provide a seal arrangement which ensures security but which is fashioned from a material which is less detrimental to the environment than lead.

For example, in U.S. Pat. Nos. 4,223,424, 4,306,745, 4,333,210, 4,365,833, 4,610,053. 4,676,535 and 4,895,402, various types of security seals are proposed which are fashioned of a plastic material.

A common disadvantage shared by the above-noted proposed seals resides in the fact that they are all multipartite and, consequently, not only relatively expensive to manufacture and assemble but also somewhat difficult to manipulate when being applied to the bag to be sealed, in addition to not necessarily precluding a tampering with the contents of a sealed bag.

SUMMARY OF THE INVENTION

The aim underlying the present invention essentially resides in providing a security seal for bags or the like which ensures a firm anchoring of the seal to the bag and precludes any tampering with the contents thereof.

In accordance with advantageous features of the present invention, a tamperproof security seal is provided for a container such as, for example, a currency bag, mail bag, or the like, which includes a seal member having a plurality of partition walls disposed in parallel to one another and in parallel to end wall sections so as to define therebetween a plurality of channels extending across a width of the seal member. A plurality of holes, arranged in a row, are provided in each of the partition walls and the end wall sections, with the holes extending the partition walls and the end wall sections in a direction perpendicular to the longitudinal center axis of the respective channels. The holes in the partition walls and the end wall sections are disposed in alignment so as to enable a drawstring to be threaded therethrough in a such manner that a loop portion is formed on one side of the seal member and is adapted to be placed around an opening of the container, with free ends of the drawstring being disposed on an opposite side of the seal member. Upon a crimping of the seal member, the partition walls and the end wall sections are deformed such that the openings form individual anchoring points on the drawstring, thereby preventing a withdraw of the drawstring from the seal member and preventing unauthorized access to the container.

Advantageously, the seal member is made of a soft material, which may, for example, be a pure aluminum or an aluminum alloy.

The partition walls and the end wall sections are, in accordance with the present invention, integrally formed in one piece and subsequently bent so as to define the plurality of channels.

In accordance with further advantageous features of the present invention, a method of manufacturing the tamperproof security seal comprises the steps of cutting a sheet of soft material to a predetermined size and providing a plurality of press lines spaced from each other along a length of the sheet so as to divide the same into a plurality of sections. A row of through holes is then provided in each of the sections such that the sheet then includes sections of through holes separated by areas of imperforated sheet material. The sheet is subjected to a first forming step so as to bend the same into a substantially a U-shaped configuration, and is then subjected to subsequent forming steps so that the sections provided with holes are disposed in parallel to one another and define opposed end wall sections having a plurality of partition walls disposed therebetween, and with the partition walls being spaced from each other and the end wall section so as to define a plurality of transversely extending channels having the holes in the sections extending in a direction perpendicular to a longitudinal center axis of the channels.

The above and other objects, features and advantages of the present invention will become more apparent from the following description when taken in connection with the accompanying drawings which show, for the purpose of illustration only, one embodiment in accordance with the present invention.

DETAILED DESCRIPTION

Figure 1:
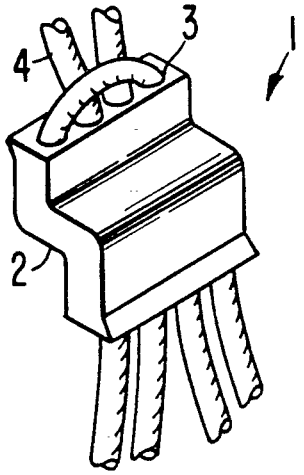
FIG. 1 is a perspective view of a crimped conventional lead security seal.
Figure 2:
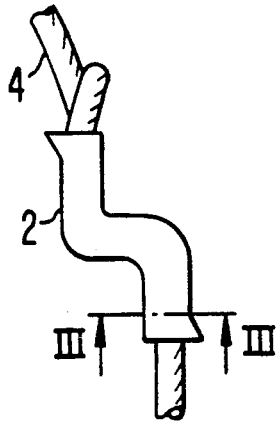
FIG. 2 is a side view of the conventional security seal of FIG. 1.
Figure 3:
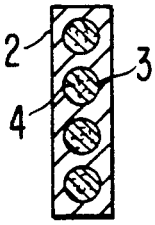
FIG. 3 is a cross sectional view of the conventional security seal taken along the line II-II in FIG. 2.

Referring now to the drawings wherein like reference numerals are used throughout the various views to designate like parts and, more particularly, to FIGS. 1–3, according to these figures, a conventional seal generally designated by the reference numeral 1 includes a lead body 2 having a plurality of holes 3 extending therethrough for accommodating a drawstring 4. The seal 1 is placed around the neck of a bag (not shown) and the drawstring 4 is drawn tightly to close the opening of the bag. The seal 1 is then crimped by a conventional crimping tool (not shown) of the type disclosed, for example, in U.S. Pat. No. 3,911,970, thereby resulting in the seal 1 being deformed and assuming a configuration such as shown in FIG. 2. The crimping action results in the deforming of the holes 3 resulting in an anchoring of the drawstring 4 in the lead body 2 forming the seal 1.

Figure 4:
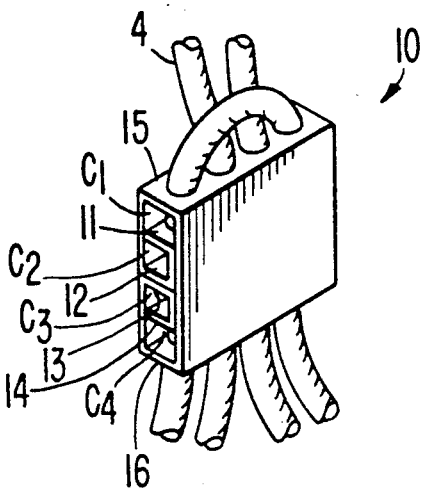
FIG. 4 is a perspective view of a security seal constructed in accordance with the present invention.
Figure 5:
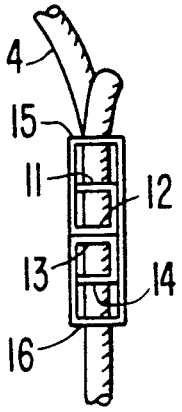
FIG. 5 is an end view of the security seal of FIG. 4.

In accordance with the present invention, as shown most clearly in FIGS. 4–6, a seal member generally designated by the reference numeral 10, fashioned of a soft aluminum consisting essentially of, by weight, 99% and other ingredients including 0.25% Si, 0.40% Fe, 0.05% Cu, 0.05% Mn, 0.05% Mg, 0.03% Ti, 0.03% Pd and 0.05% Zn, is formed, in a manner described more fully hereinbelow, so as to provide for a plurality of partition wall sections 11–14 and end wall section 15, 16, with each partition and end wall section 11–16, including a row of aligned holes 17. The row of aligned holes 17 in each of the partition and end wall sections 11–16 are disposed in alignment so as to enable a threading of a drawstring therethrough subsequent to the forming of the seal member 10. The partition wall sections 11–14 and end wall sections are arranged so as to define a plurality of parallel channels $C_1$–$C_4$, with the holes 17 extending transversely to the longitudinal axis of the respective channels $C_1$–$C_4$.

With the drawstring 4 threaded through the holes 17, the seal member 10 is placed around a bag 20, and the drawstring 4 is drawn tightly to securely close the opening of the bag 20. A conventional crimping tool (not shown) is then employed to crimp the seal member 10 thereby resulting in a seal member 10 being deformed into a configuration substantially as shown in FIG. 6.

Figure 6:
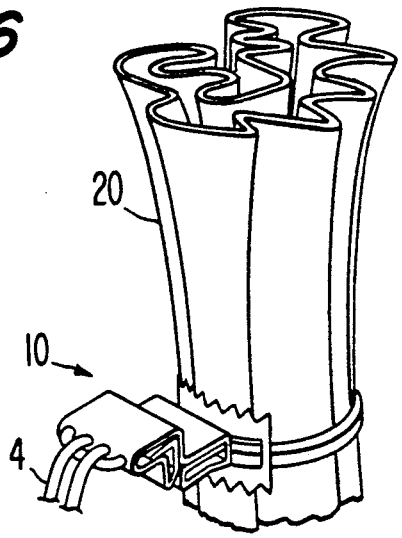
FIG. 6 is a perspective view of the security seal of FIG. 4, in a crimped condition, applied to a pouch or bag; and, FIGS. 7(*a*)–7(*g*), sequentially depict the steps of the method of forming the security seal constructed in accordance with the present invention.
Figure 7A:
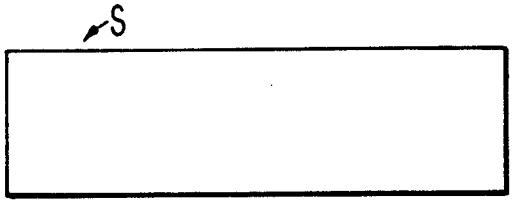
Figure 7B:
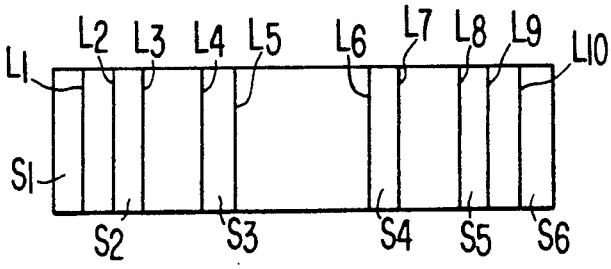
Figure 7C:
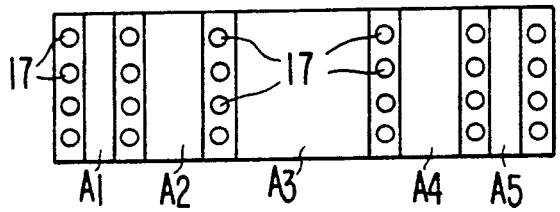
Figure 7D:
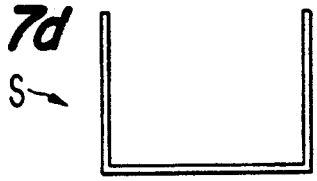
Figure 7F:
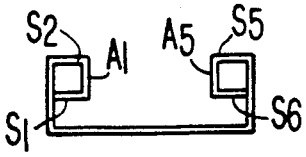
Figure 7E:
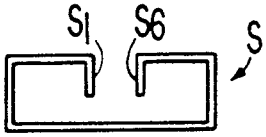
Figure 7G:
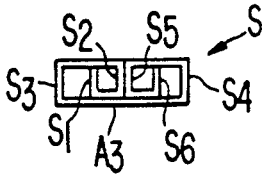

By virtue of the deformation of the seal member 10, as shown most clearly in FIG. 6, the drawstring 4 follows a serpentine path, with the drawstring 4 being firmly clamped or anchored at each partition wall sections 11–14 thereby preventing any possible withdrawal of the drawstring 4 from the seal member 10 and ensuring a firm clamping or looking of the opening of the bag 20.

Moreover, by virtue of the provision of the plurality of partition wall sections 11–14 and subsequent partial deformation thereof by the crimping tool, it is virtually impossible to tamper with the seal member 10 by attempting to pry the same open without completely destroying the seal member 10, since each of the partition wall sections 11–14 form an independent locking or anchoring means for the drawstring 4. Thus, the seal member 10 of the present invention provides an effective tamperproof security seal for a bag 20 such as, for example, a currency bag, mail bag, or any other similar container for which security is desired.

To manufacture the seal member 10, in accordance with the method of the present invention, as shown in FIG. 7(*a*), a soft aluminum sheet generally designated by the reference character S is cut by a conventional press (not shown) to a desired size, and press or score lines $L_1$–$L_6$ are provided in the sheet S to facilitate subsequent forming or bending of the sheet S as shown in FIG. 7(*b*). The holes 17 are then punched or drilled in sections $S_1$–$S_6$ in a conventional manner so as to result in a sheet Wherein sections $S_1$–$S_6$ are respectively separated by solid imperforated areas $A_1$–$A_5$ as shown in FIG. 7(*c*). In the finished seal 10, the sections $S_1$–$S_6$ form the end wall sections 15–16 and the partition wall sections 11–14.

Subsequent to the punching or drilling of the holes 17, the sheet S is then subjected to a first forming step resulting in the sheet S being formed into a substantially U shape as shown in FIG. 7(*d*). The sheet S is then subjected to a second forming step wherein the sections $S_1$, $S_6$ are bent inwardly in a direction of the area $A_3$ of the sheet S as shown in FIG. 7(*e*). The sheet then is subjected to a third forming step wherein the sections $S_1$, $S_6$ are respectively bent in a direction of the areas $A_2$, $A_4$, with the sections $S_1$, $S_6$ being disposed substantially in parallel to the area $A_3$ as shown in FIG. 7(*f*).

The sheet S is then subjected to a final forming step wherein the sections $S_1$–$S_6$ are brought into a parallel alignment with each other, with the respective holes 17 in the respective sections $S_1$–$S_6$ also being in alignment as shown in FIG. 7(*g*). The drawstring 4 is then threaded or passed through the aligned holes 17 in the sections $S_1$–$S_6$, forming the partition wall sections 11–14 and end wall section 15, 16, thereby resulting in the seal member 10 shown in FIG. 4.

In the illustrated embodiment, each section $S_1$–$S_6$ is provided with a row of four aligned holes 17; however, it is understood that any member of holes 17 may be provided in the respective sections $S_1$–$S_6$ depending upon the size of the seal member 10.

As can readily be appreciated, the forming of the sheet S in the steps described hereinabove can be readily carried out by a conventional apparatus employing suitable conventional dies.

While I have shown and described only one embodiment in accordance with the present invention, it is understood that the same is not limited thereto but is susceptible to numerous changes and modification as known to one of ordinary skill in the art, and I therefore do not wish to be limited to the details shown and described herein, but intend to cover all such modifications as are encompassed by the scope of the appended claims.

I claim:

1. A tamperproof security seal for a container comprising a seal member including a plurality of partition walls disposed in parallel to one another and in parallel to end wall sections so as to define a plurality of channels extending across a width of the seal member, a plurality of aligned holes provided in each of said partition walls and said end wall sections, said holes extending through said partition walls and said end wall sections in a direction perpendicular to a longitudinal center axis of the respective channels, said holes in said partition walls and said end wall sections being disposed in alignment so as to enable a drawstring to be threaded therethrough in such a manner that a loop portion is formed on one side of the seal member and is adapted to be placed around the container, with free ends of the drawstring being disposed on an opposite side of the seal member, and wherein, upon a crimping of said seal member, said partition walls and said end wall sections are deformed whereby said openings form individual anchoring points on the drawstring so as to prevent a withdrawal of the drawstring from the seal member and prevent unauthorized access to the container.

2. A tamperproof security seal according to claim 1, wherein said seal member is formed of a soft material.

3. A tamperproof security seal according to claim 2, wherein the soft material is one of pure aluminum or an aluminum alloy.

4. A tamperproof security seal according to claim 3, wherein said partition walls and said end wall sections are integrally formed in one piece and bent so as to define said plurality of channels.

5. A method of manufacturing a tamperproof security seal, the method comprising the steps of cutting a sheet of soft material to a predetermined size;

providing a plurality of press lines spaced from each other along a length of the sheet so as to divide the same into a plurality of sections;

providing a roll of through holes in each of said sections such that said sheet includes sections of through holes separated by areas of imperforated sheet material;

subjecting said sheet to a first forming step so as to bend the same into a substantially U-shaped configuration;

subjecting the U-shaped sheet to sequential forming steps so that said sections provided with holes are disposed in parallel to one another and define end wall sections having a plurality of partition walls disposed therebetween, with the partition walls being spaced from each other and from said end wall sections so as to define a plurality of transversely extending channels having the holes in said sections extending in a direction perpendicular to a longitudinal center axis of said channels.

6. The method according to claim 5, wherein the step of providing holes includes one of punching or drilling said holes in said sections.

7. A method according to claim 6, wherein said soft material is one of pure aluminum or an aluminum alloy.

* * * * *